US008199073B2

(12) United States Patent
Chung et al.

(10) Patent No.: US 8,199,073 B2
(45) Date of Patent: Jun. 12, 2012

(54) ELECTRO-LUMINESCENCE DISPLAY DEVICE THAT REDUCES THE NUMBER OF OUTPUT CHANNELS OF A DATA DRIVER

(75) Inventors: Hoon Ju Chung, Pyungtack-shi (KR); Jae Ho Sim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 970 days.

(21) Appl. No.: 11/020,200

(22) Filed: Dec. 27, 2004

(65) Prior Publication Data

US 2005/0243034 A1 Nov. 3, 2005

(30) Foreign Application Priority Data

Apr. 30, 2004 (KR) ..... 10-2004-0030509

(51) Int. Cl.
*G09G 3/30* (2006.01)

(52) U.S. Cl. ..... 345/76; 345/77; 315/169.3

(58) Field of Classification Search ..... 345/87, 345/30, 76–82
See application file for complete search history.

(56) References Cited

U.S. PATENT DOCUMENTS

| | | | | |
|---|---|---|---|---|
| 5,021,774 | A | 6/1991 | Ohwada et al. | |
| 5,113,181 | A | 5/1992 | Inoue et al. | |
| 5,325,442 | A | 6/1994 | Knapp | |
| 5,376,841 | A | 12/1994 | Itakura et al. | |
| 5,585,666 | A | 12/1996 | Imamura | |
| 5,708,454 | A * | 1/1998 | Katoh et al. | 345/100 |
| 5,892,493 | A * | 4/1999 | Enami et al. | 345/94 |
| 6,313,819 | B1 | 11/2001 | Maekawa et al. | |
| 6,333,729 | B1 | 12/2001 | Ha | |
| 6,424,328 | B1 * | 7/2002 | Ino et al. | 345/87 |
| 6,448,718 | B1 | 9/2002 | Battersby | |
| 6,703,994 | B2 | 3/2004 | Edwards | |
| 6,788,277 | B2 * | 9/2004 | Kanauchi et al. | 345/77 |
| 6,924,784 | B1 | 8/2005 | Yeo et al. | |
| 7,088,330 | B2 * | 8/2006 | Nagata et al. | 345/100 |
| 7,123,232 | B1 * | 10/2006 | Edwards | 345/98 |
| 7,268,756 | B2 * | 9/2007 | Koyama et al. | 345/87 |
| 2003/0179164 | A1 | 9/2003 | Shin et al. | |

FOREIGN PATENT DOCUMENTS

| | | |
|---|---|---|
| CN | 1301377 | 6/2001 |
| JP | 63-217326 | 9/1988 |
| JP | 2000-356978 | 12/2000 |
| JP | 2004-037498 | 2/2004 |
| WO | WO 01/09871 | 2/2001 |

* cited by examiner

*Primary Examiner* — Duc Dinh
(74) *Attorney, Agent, or Firm* — McKenna, Long and Aldridge, LLP.

(57) ABSTRACT

An electro-luminescence display device for reducing the number of output channels of a data driver is disclosed. An electro-luminescence (EL) display device according to the present invention includes an EL display panel having a plurality of pixels; m data electrode lines (wherein m is an integer) and a plurality of scan electrode lines in the EL display panel, the data electrode lines and the scan electrode lines defining the pixels; a data driver having a plurality of output channels for supplying data signals to the m data electrode lines; and a multiplexer for connecting each output channel of the data driver to k data electrode lines (wherein k is an integer greater than 2).

11 Claims, 8 Drawing Sheets

ELECTRO-LUMINESCENCE DISPLAY DEVICE THAT REDUCES THE NUMBER OF OUTPUT CHANNELS OF A DATA DRIVER

This application claims the benefit of Korean Patent Application No. P2004-30509 filed in Korea on Apr. 30, 2004, which is hereby incorporated by reference for all purposes as if fully set forth herein.

BACKGROUND OF THE INVENTION

1. Field of the Invention

This invention relates to an electro-luminescence display (ELD), and more particularly to an electro-luminescence display device that reduces the number of output channels of a data driver.

2. Discussion of the Related Art

Recently, various flat panel display devices have been developed with reduced weight and size that are capable of eliminating the disadvantages associated with cathode ray tubes (CRT). Such flat panel display devices include liquid crystal displays (LCD), field emission displays (FED), plasma display panels (PDP) and electro-luminescence (EL) panels, etc.

An electro-luminescence (EL) display is a self-luminous device in which a phosphorous material emits light by recombination of electrons and holes. The EL display is largely classified into an inorganic EL display device and an organic EL display device, depending upon its material and structure. The EL display has the same advantage as cathode ray tubes (CRT) in that it has a faster response speed than passive-type light-emitting devices such as liquid crystal displays (LCD), which require a separate light source.

FIG. 1 is a sectional view illustrating a general structure of an organic EL device for explaining a light-emitting principle of the EL display device. Referring to FIG. 1, the organic EL display device includes an electron injection layer 4, an electron carrier layer 6, a light-emitting layer 8, a hole carrier layer 10 and a hole injection layer 12 that are sequentially disposed between a cathode 2 and an anode 14. When a voltage is applied between a transparent electrode, that is, the anode 14 and a metal electrode, that is, the cathode 2, then electrons produced from the cathode 2 are injected, via the electron injection layer 4 and the electron carrier layer 6, into the light-emitting layer 8, while holes produced from the anode 14 are injected, via the hole injection layer 12 and the hole carrier layer 10, into the light-emitting layer 8. Thus, the electrons and the holes fed from the electron carrier layer 6 and the hole carrier layer 10, respectively, are collided and recombined at the light-emitting layer 8 to generate light. Then, this light is emitted, via the transparent electrode (i.e., the anode 14), into the exterior to thereby display a picture.

Referring to FIG. 2, a related art EL display device employing such an organic EL device includes an EL display panel 16 having pixel cells PE arranged at areas defined by scan electrode lines SL1 to SLn and data electrode lines DL1 to DLm, a scan driver 18 for driving the scan electrode lines SL1 to SLn, a data driver 20 for driving the data electrode lines DL1 to DLm, and a timing controller 28 for controlling each driving timing of the scan driver 18 and the data driver 20.

Referring to FIG. 3, each PE cell 22 includes a supply voltage line VDD, a light-emitting cell OLED connected between the supply voltage line VDD and a ground voltage line GND, and a light-emitting cell driving circuit 30 for driving the light-emitting cell OLED in response to a driving signal supplied from each of the data electrode lines DL and the gate electrode lines SL.

The light-emitting cell driving circuit 30 includes a driving thin film transistor (TFT) DT connected between the supply voltage line VDD and the light-emitting cell OELD, a switching TFT SW connected to the scan electrode lines SL, the data electrode lines DL and the driving TFT DT, and a storage capacitor Cst connected between a first node N1 positioned between the driving TFT DT and the switching TFT SW and the supply voltage line VDD. Herein, the TFTs are a p-type electron metal-oxide semiconductor field effect transistor (MOSFET). A gate terminal of the driving TFT DT is connected to a drain terminal of the switching TFT SW; a source terminal thereof is connected to the supply voltage line VDD; and a drain terminal thereof is connected to the light-emitting cell OLED. A gate terminal of the switching TFT SW is connected to the scan electrode line SL; a source terminal thereof is connected to the data electrode line DL; and a drain terminal thereof is connected to the gate terminal of the driving TFT DT.

Referring back to FIG. 2, the timing controller 28 generates a data control signal for controlling the data driver 20 and a scan control signal for controlling the scan driver 18 using synchronizing signals supplied from an external system (e.g. a graphic card). Further, the timing controller 28 applies a data signal from the external system to the data driver 20. The scan driver 18 generates a scanning pulse SP in response to the scanning control signal from the timing controller 28, and applies the scanning pulse SP to the scan electrode lines SL1 to SLn to sequentially drive the scan electrode lines SL1 to SLn. The data driver 20 supplies a data voltage to the data electrode lines DL1 to DLm every horizontal period 1H in response to the data control signal from the timing controller 28. In this case, the data driver 20 has DLm output channels 21 that are matched with the data electrode lines DL1 to DLm in an one to one relationship.

In each pixel cell PE of the related art EL display device, when a scanning pulse SP having a low state LOW is inputted to the scan electrode line SL from the scan driver 18, the switching TFT SW is turned on. As the switching TFT SW is turned on, a data voltage supplied from the data driver 20 is applied to the first node N1, via the data electrode line DL and the switching TFT SW, in such a manner to be synchronized with the scanning pulse SP applied to the scan electrode line SL. The data voltage applied to the first node N1 is stored in the storage capacitor Cst. The storage capacitor Cst stores the data voltage from the data electrode line DL during an application time of the scanning pulse SP. Such a storage capacitor Cst holds the stored data voltage during one frame. In other words, the storage capacitor Cst applies the stored data voltage to the driving TFT DT even when the scanning pulse SP is not applied to the scan electrode line SL, to thereby turn on the driving TFT DT until the next frame. Thus, the light-emitting cell OLED is turned on by a voltage difference between the supply voltage line VDD and the ground voltage GND, thereby emitting light in proportion to a current amount applied from the supply voltage line VDD via the driving TFT DT.

In such a related art EL display device, the scan driver 18 is integral to the EL display panel 16 in a row direction, and the output channels 21 of the data driver 20 and the data electrode lines DL1 to DLm form an one-to-one matching in a column direction with respect to each other, as shown in FIG. 2. Because the output channels 21 of the data driver 20 is in an one-to-one relationship with the data electrode lines DL1 to DLm, the number of the output channels 21 of the data driver 20 needs to be the same as the number of the data electrode lines DL1 to DLm.

More specifically, according to the related art EL display device, the number of the signal wirings needs to be three times the resolution of the EL display panel 16 in order to connect the output channels 21 of the data driver 20 to the data electrode lines DL. Thus, as the EL display panel has a higher resolution, which means that the number of the output channels of the data driver increases, it becomes difficult to form an one-to-one connection between the data driver 20 and the data electrode lines DL. Therefore, an EL display device capable of making an easy connection between the data driver 20 and the data electrode lines DL would be beneficial, even when a resolution of the EL display panel 16 becomes higher.

SUMMARY OF THE INVENTION

Accordingly, the present invention is directed to an electro-luminescence display device that substantially obviates one or more of the problems due to limitations and disadvantages of the related art.

An advantage of the present invention is to provide an electro-luminescence display device that reduces the number of output channels of a data driver.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other objects of the invention, an electro-luminescence (EL) display device according to an embodiment of the present invention includes an EL display panel having a plurality of pixels; m data electrode lines (wherein m is an integer) and a plurality of scan electrode lines in the EL display panel, the data electrode lines and the scan electrode lines defining the pixels; a data driver having a plurality of output channels for supplying data signals to the m data electrode lines; and a multiplexer for connecting each output channel of the data driver to k data electrode lines (wherein k is an integer greater than 2).

The electro-luminescence display device further includes a scan driver for sequentially applying a scanning pulse to the plurality of scan electrode lines; and a timing controller for controlling the data driver and the scan driver and for applying the data signals to the data driver and controlling the multiplexer.

The multiplexer includes m writing switching devices connected to the respective data electrode lines; m buffers connected to the respective writing switching devices; m multiplexer switching devices connected to the respective buffers and commonly connected to each output channel of the data driver for each k unit; and m capacitors connected between a node positioned between the multiplexer switching devices and the buffers and a ground voltage line to temporarily store the data signals supplied via the multiplexer switching devices.

Herein, each of the buffers includes a complementary metal-oxide-semiconductor (CMOS) transistor.

The timing controller generates a selection signal for sequentially switching the k multiplexer switching devices and a writing signal for switching the m writing switching devices.

Herein, the m multiplexer switching devices are switched during a half of an ON time of the scan electrode line, and the m writing switching devices are switched during the remaining half of said ON time of the scan electrode line.

The electro-luminescence display device further includes a pre-charger connected to each of the data electrode lines to pre-charge each of the data electrode lines.

The pre-charger includes m pre-charging switching devices connected between each end of the data electrode lines and a ground voltage line.

Herein, the timing controller generates a selection signal for sequentially switching said k of the m multiplexer switching devices, a writing signal for switching the m writing switching devices and a pre-charging signal for switching the m pre-charging switching devices.

The m multiplexer switching devices are switched during a half of an ON time of the scan electrode line; the m pre-charging switching devices are switched during said half of said On time of the scan electrode line; and the m writing switching devices are switched during the remaining half of said ON time of the scan electrode line.

Herein, each of the m buffers includes a positive-channel metal-oxide-semiconductor (PMOS) transistor connected between a supply voltage line and the ground voltage line; and a capacitor connected between the supply voltage line and a gate terminal of the PMOS transistor.

Each of the pixel cells includes: a light-emitting cell connected between a supply voltage line and a ground voltage line; a driving switch connected between the supply voltage line and the light-emitting cell; a switching device connected to the scan electrode line, the data electrode line and the driving switch; and a capacitor between a node between the driving switch and the switching device and the supply voltage line.

In another aspect of the present invention, a flat panel display device includes a display panel having a plurality of pixels; m data electrode lines (wherein m is an integer) and a plurality of scan electrode lines in the display panel, the data electrode lines and the scan electrode lines defining the pixels; a data driver having a plurality of output channels for supplying data signals to the m data electrode lines; and a multiplexer for connecting each output channel of the data driver to k data electrode lines (wherein k is an integer greater than 2).

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawing.

Figure 4:
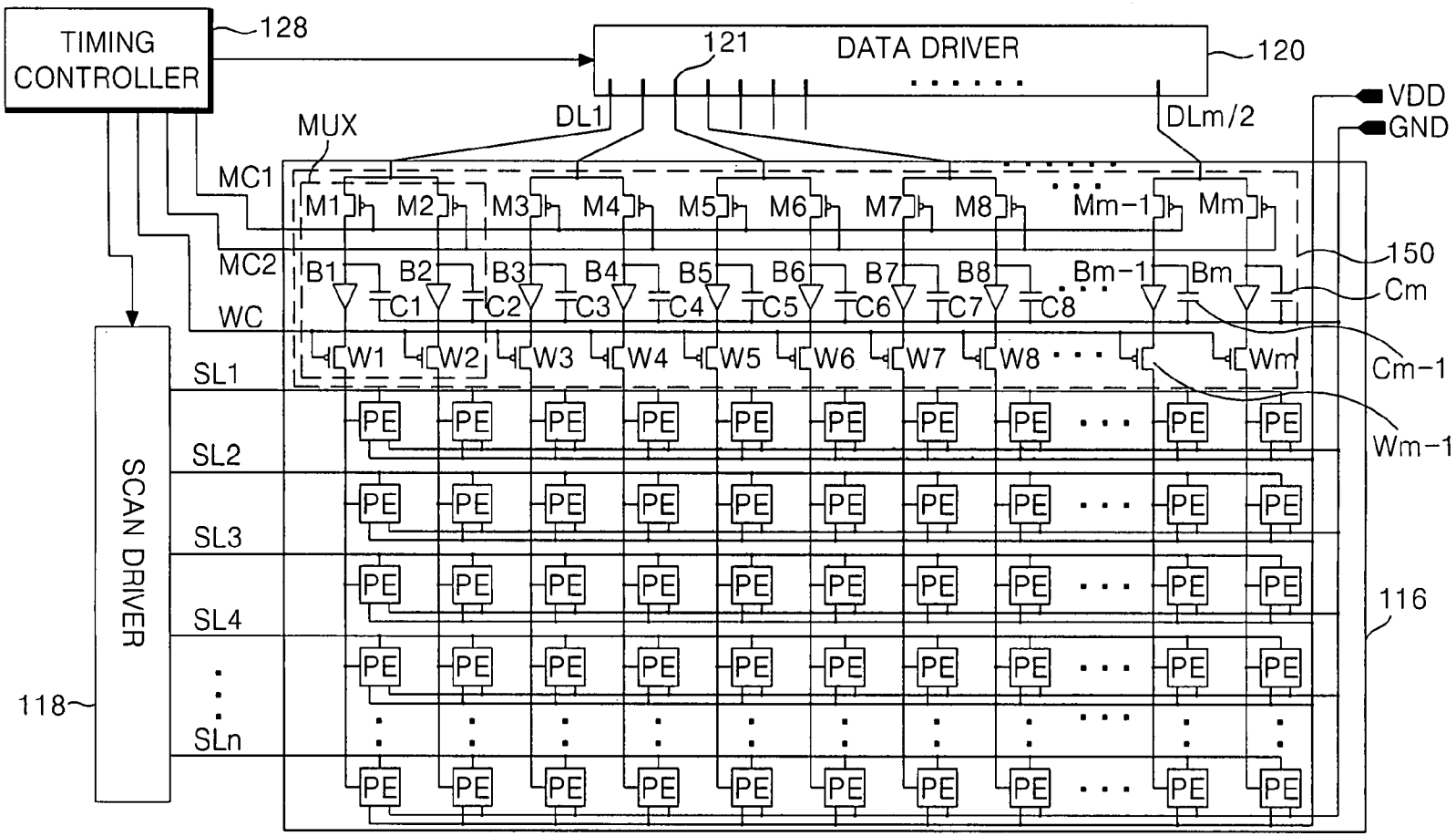
FIG. 4 is a block diagram illustrating a configuration of an electro-luminescence display device according to a first embodiment of the present invention.

FIG. 4 is a block diagram illustrating a configuration of an electro-luminescence display device according to a first embodiment of the present invention. Referring to FIG. 4, an EL display device according to the first embodiment of the present invention includes an EL display panel 116 having pixel cells PE arranged at areas defined by scan electrode lines SL1 to SLn and data electrode lines DL1 to DLm, a scan driver 118 for driving the scan electrode lines SL1 to SLn, and a data driver 120 for driving the data electrode lines DL1 to DLm. The EL display device further includes a multiplexer part 150 having a plurality of multiplexers MUX for selectively connecting one of output channels of the data driver 120 to respective k data electrode lines DL1 to DLk (wherein k is an integer greater than 2), and a timing controller 128 for controlling each driving timing of the scan driver 118 and the data driver 120 and for driving the multiplexer part 150.

Figure 1:
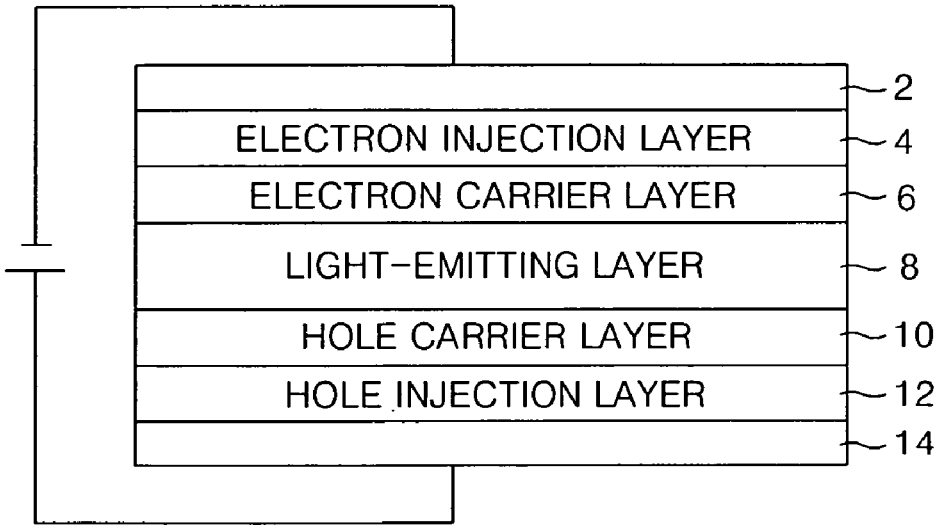
FIG. 1 RELATED ART
FIG. 1 is a schematic section view illustrating a structure of an organic light-emitting cell in a general electro-luminescence display panel.
Figure 2:
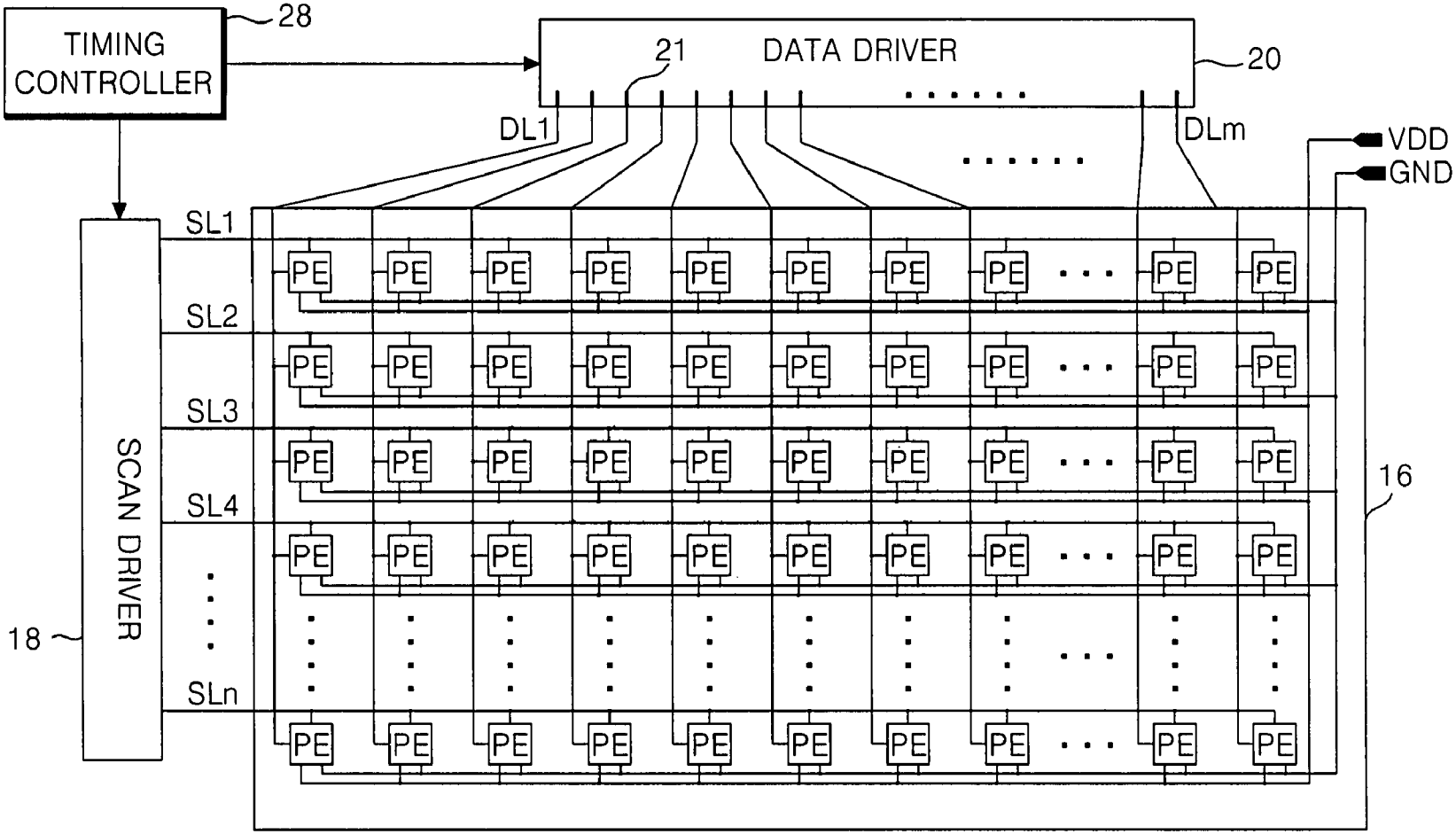
FIG. 2 RELATED ART
FIG. 2 is a block diagram illustrating a configuration of a related art electro-luminescence display device.
Figure 3:
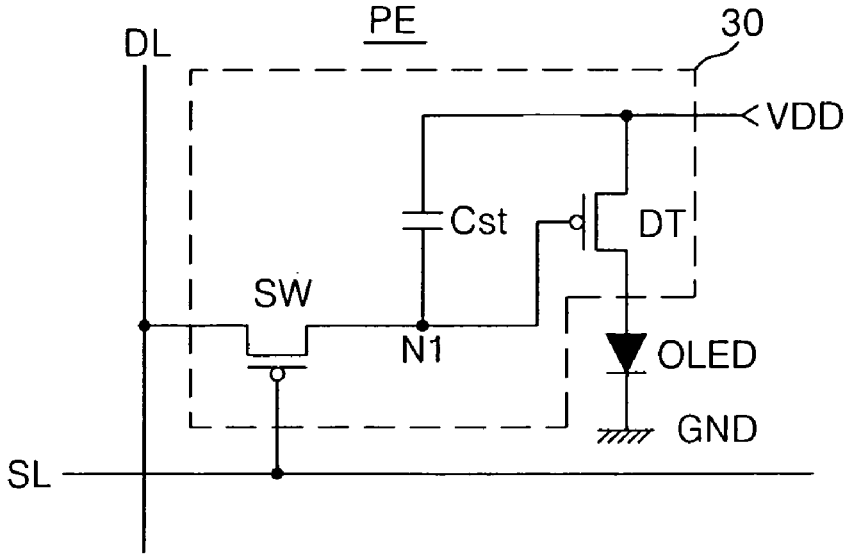
FIG. 3 RELATED ART
FIG. 3 is an equivalent circuit diagram of each pixel cell shown in FIG. 2.

Each pixel cell PE includes a supply voltage line VDD, a light-emitting cell OLED connected between the supply voltage line VDD and a ground voltage line GND, and a light-emitting cell driving circuit 30 for driving the light-emitting cell OLED in response to a driving signal supplied from each of the data electrode lines DL and the gate electrode lines SL, as shown in FIG. 3. The light-emitting cell driving circuit 30 includes a driving thin film transistor (TFT) DT connected between the supply voltage line VDD and the light-emitting cell OELD, a switching TFT SW connected to the scan electrode lines SL, the data electrode lines DL and the driving TFT DT, and a storage capacitor Cst connected between a first node N1 positioned between the driving TFT DT and the switching TFT SW and the supply voltage line VDD. Herein, the TFTs are a p-type electron metal-oxide semiconductor field effect transistor (MOSFET). A gate terminal of the driving TFT DT is connected to a drain terminal of the switching TFT SW; a source terminal thereof is connected to the supply voltage line VDD; and a drain terminal thereof is connected to the light-emitting cell OLED. A gate terminal of the switching TFT SW is connected to the scan electrode line SL; a source terminal thereof is connected to the data electrode line DL; and a drain terminal thereof is connected to the gate terminal of the driving TFT DT.

The timing controller 128 generates a data control signal for controlling the data driver 120 and a scan control signal for controlling the scan driver 118 using synchronizing signals supplied from an external system (e.g. a graphic card). Further, the timing controller 128 applies a data signal from the external system to the data driver 120. The timing controller 128 also applies selection signals, for example, first and second selection signals MC1 and MC2, and a writing signal WC to the multiplexer part 150, as shown in FIG. 5.

Figure 5:
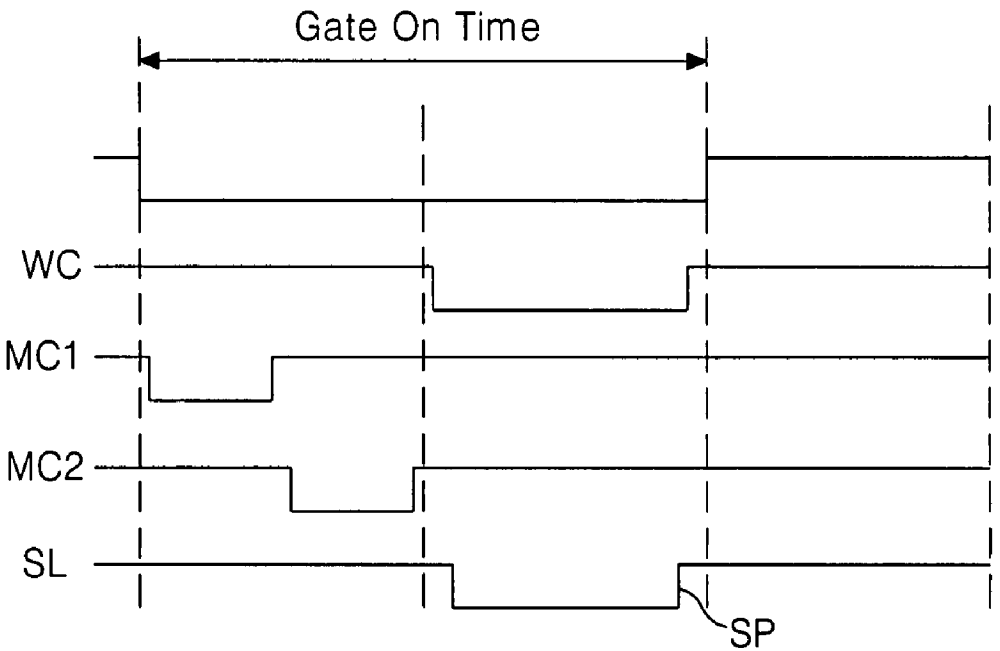
FIG. 5 is a waveform diagram of a scanning pulse, a selection signal and a data signal applied to the scan electrode line shown in FIG. 4.

Referring to FIG. 5, the first and second selection signals MC1 and MC2 are sequentially applied to the multiplexer part 150 during the OFF time of the scan electrode line SL, which is called a first half time. Then, the writing signal WC is applied to the multiplexer part 150 during a second half time (that is, ON time) of the scan electrode line in such a manner to be synchronized with a scanning pulse SP applied to the scan electrode line SL. The scan driver 118 generates a scanning pulse SP in response to the scanning control signal from the timing controller 128, and applies the scanning pulse SP to the scan electrode lines SL1 to SLn to sequentially drive the scan electrode lines SL1 to SLn. The scanning pulse SP applied from the scan driver 118 to the scan electrode line SL is supplied during the second half time of the scan electrode line SL. The data driver 120 supplies a data voltage to the data electrode lines DL1 to DLm every horizontal period 1H in response to the data control signal from the timing controller 128. The data driver 120 has DLm/k output channels 121 that are matched with the data electrode lines DL1 to DLm in an one-to-k relationship, where k is an integer greater than two. In FIG. 5, k is 2 and the data driver has DLm/2 output channels.

The multiplexer part 150 includes m writing switching devices W1 to Wm connected to the respective data electrode lines DL, m buffers B1 to Bm connected to the respective m writing switching devices W1 to Wm, m multiplexer switching devices M1 to Mm connected to the respective m buffers B1 to Bm and commonly connected to the respective output channels of the data driver for each k unit, and m capacitors C1 to Cm connected between nodes positioned between the multiplexer switching devices M and the buffers B and the ground voltage line GND.

The k multiplexer switching devices M1 to Mk are commonly connected to each one of the output channels 121 of the data driver 120. For simplicity, it is assumed in the EL display device according to the first embodiment of the present invention that first and second multiplexer switching devices M1 and M2 are connected to each output channel of the data driver 120. Accordingly, the first and second multiplexer switching devices M1 and M2, the first and second buffers B1 and B2, the first and second capacitors C1 and C2 and the first and second writing switching devices W1 and W2 constitute a single of multiplexer MUX.

The first selection signal MC1 is applied from the timing controller 128, via a first selection signal line, to the gate terminals of the odd-numbered multiplexer switching devices M1, M3, M5, . . . , Mn−1 including the first multiplexer switching device M1, while the second selection signal MC2 is applied from the timing controller 128, via a second selection signal line, to the gate terminals of the even-numbered multiplexer switching devices M2, M4, M6, . . . , Mm including the second multiplexer switching device M2. The first and second multiplexer switching devices M1 and M2 of the multiplexer MUX are sequentially switched during the first half of the ON time of the scan electrode line SL in response to the first and second selection signals MC1 and MC2 from the timing controller 128. Then, each of the m capacitors C1 to Cm charges a data voltage supplied via the output channel 121 of the data driver 120 in response to a switching of the respective m multiplexer switching devices M1 to Mm. Each of the m buffers B1 to Bm provides a signal buffering such that a data voltage stored in each of the m capacitors C1 to Cm is applied, via the respective m writing switching device W1 to Wm, to the data electrode line DL. In this case, each of the m buffers B1 to Bm includes a complementary metal-oxide-semiconductor (CMOS) transistor. Each of the m writing switching devices W1 to Wm is switched such that a data voltage stored in each of the m capacitors C1 to Cm is supplied, via the respective m buffers B1 to Bm, to the data electrode line DL in response to a writing signal WC from the timing controller 128.

An operation of the EL display device according to the first embodiment of the present invention will be described in detail with reference to FIGS. 4 and 5.

First, the first and second selection signals MC1 and MC2 from the timing controller 128 are applied to the multiplexer part 150 during an ON time corresponding to the first half of the ON time of the scan electrode line SL. Then, each of the multiplexer MUX sequentially applies a data voltage supplied from each output channel 121 of the data driver 120 to the first and second capacitors C1 and C2 in response to the first and second selection signals MC1 and MC2. Accordingly, each of the first and second capacitors C1 and C2 of the multiplexer MUX stores a data voltage supplied via each of the first and second multiplexer switching devices M1 and M2.

Subsequently, a scanning pulse SP is applied from the scan driver 118 to the scan electrode line SL and, at the same time, a writing signal WC is applied from the timing controller 128 to the multiplexer part 150. Then, each of the multiplexers MUX applies a data voltage stored in each of the first and second capacitors C1 and C2, via each of the first and second writing switching devices W1 and W2, to the data electrode lines DL.

Accordingly, in each pixel cell of the EL display device according to the first embodiment of the present invention, when a scanning pulse SP having a low state LOW is inputted from the scan driver 118 to the scan electrode line SL, then the switching TFT SW is turned on. As the switching TFT SW is turned on, a data voltage supplied from the data driver 120, via the multiplexer part 150, to the data electrode line DL is applied, via the switching TFT SW, to the first node N1 in such a manner to be synchronized with the scanning pulse SP applied to the scan electrode line SL. The data voltage applied to the first node N1 is stored in the storage capacitor Cst. The storage capacitor Cst stores the data voltage from the data electrode line DL during an application time of the scanning pulse SP to the scan electrode line SL. Such a storage capacitor Cst holds the stored data voltage during one frame. In other words, the storage capacitor Cst applies the stored data voltage to the driving TFT DT even when the scanning pulse SP is not applied to the scan electrode line SL, to thereby turn on the driving TFT DT. Thus, the light-emitting cell OLED is turned on by a voltage difference between the supply voltage line VDD and the ground voltage GND, thereby emitting light in proportion to a current amount applied from the supply voltage line VDD via the driving TFT DT.

In the EL display device according to the first embodiment of the present invention, the scan driver 118 is integral to the EL display panel 116 in a row direction, and the output channels 121 of the data driver 120 and the data electrode lines DL1 to DLm form an one-to-two matching in a column direction with respect to each other. Accordingly, the EL display device can reduce the number of the output channels 121 of the data driver 120 corresponding to the number of the data electrode lines DL1 to DLm by half. Meanwhile, in the EL display device according to the first embodiment of the present invention, the output channels 121 of the data driver 120 and the data electrode lines DL1 to DLm can also form an one-to-k matching with respect to each other by the multiplexer part 150, which can reduce the number of the output channels 121 of the data driver 120 corresponding to the number of the data electrode lines DL1 to DLm to DL/m channels.

Figure 6:
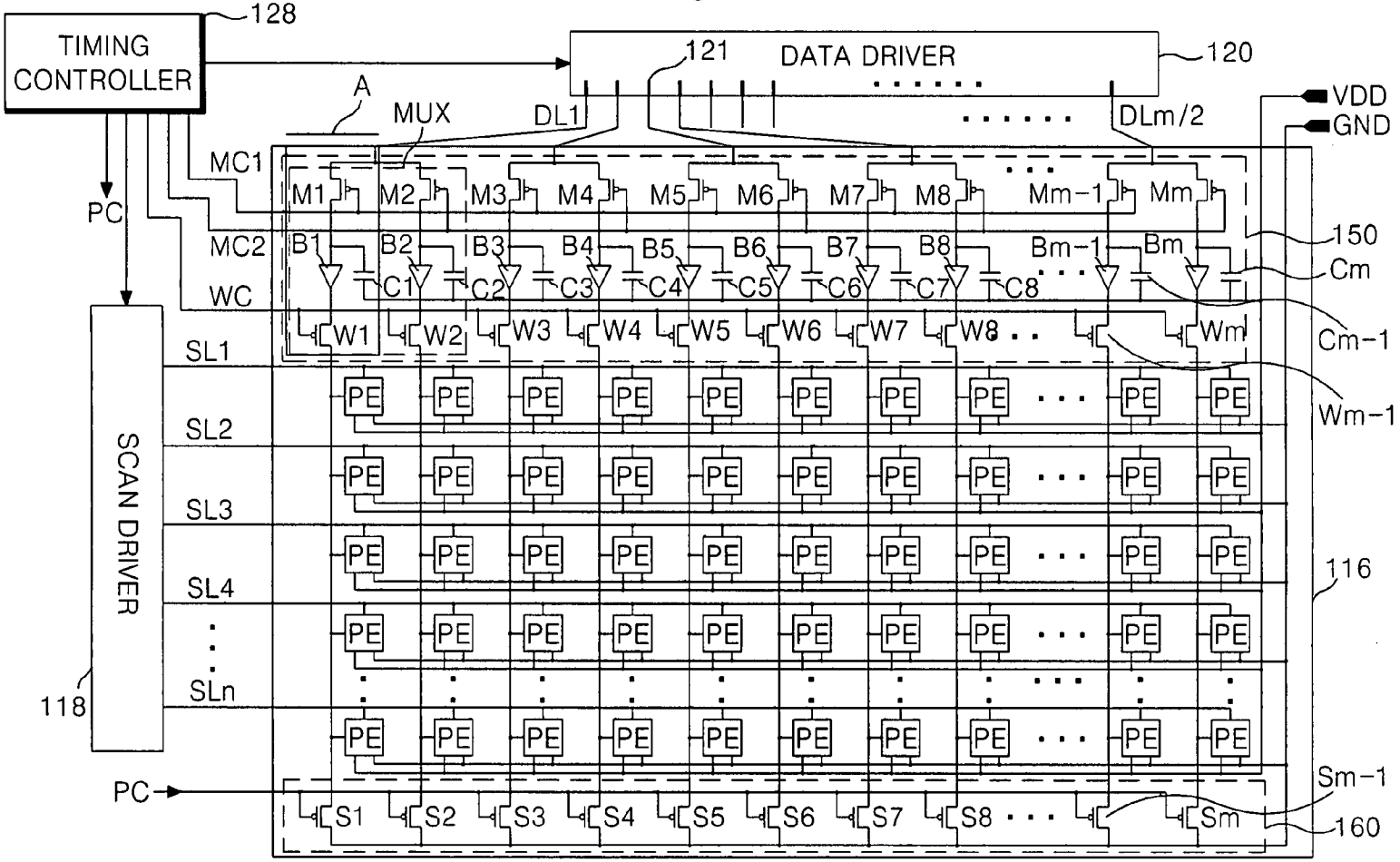
FIG. 6 is a block diagram illustrating a configuration of an electro-luminescence display device according to a second embodiment of the present invention.

FIG. 6 is a block diagram illustrating a configuration of an electro-luminescence display device according to a second embodiment of the present invention. Referring to FIG. 6, an EL display device according to the second embodiment of the present invention includes an EL display panel 116 having pixel cells PE arranged at areas defined by scan electrode lines SL1 to SLn and data electrode lines DL1 to DLm, a scan driver 118 for driving the scan electrode lines SL1 to SLn, and a data driver 120 for driving the data electrode lines DL1 to DLm. The EL display device further includes a multiplexer part 150 having a plurality of multiplexers MUX for selectively connecting one of output channels of the data driver 120 to respective k data electrode lines DL1 to DLk, a pre-charger 160 connected to the data electrode lines DL to pre-charge the data electrode line DL, and a timing controller 128 for controlling each driving timing of the scan driver 118 and the data driver 120 and for driving the multiplexer part 150 and the pre-charger 160.

The EL display device according to the second embodiment of the present invention has the same elements and functions as the above-mentioned EL display device according to the first embodiment of the present invention except for the multiplexer part 150, the pre-charger 160 and the timing controller 128. Thus, in the EL display device according to the second embodiment of the present invention, an explanation on other elements except for the multiplexer part 150, the pre-charger 160 and the timing controller 128 will be omitted for simplicity.

In the EL display device according to the second embodiment of the present invention, the timing controller 128 generates a data control signal for controlling the data driver 120 and a scan control signal for controlling the scan driver 118 using synchronizing signals supplied from an external system (e.g. a graphic card). Further, the timing controller 128 applies a data signal from the external system to the data driver 120. The timing controller 128 also applies selection signals, for example, first and second selection signals MC1 and MC2, a pre-charging signal PC and a writing signal WC to the multiplexer part 150, as shown in FIG. 7.

Figure 7:
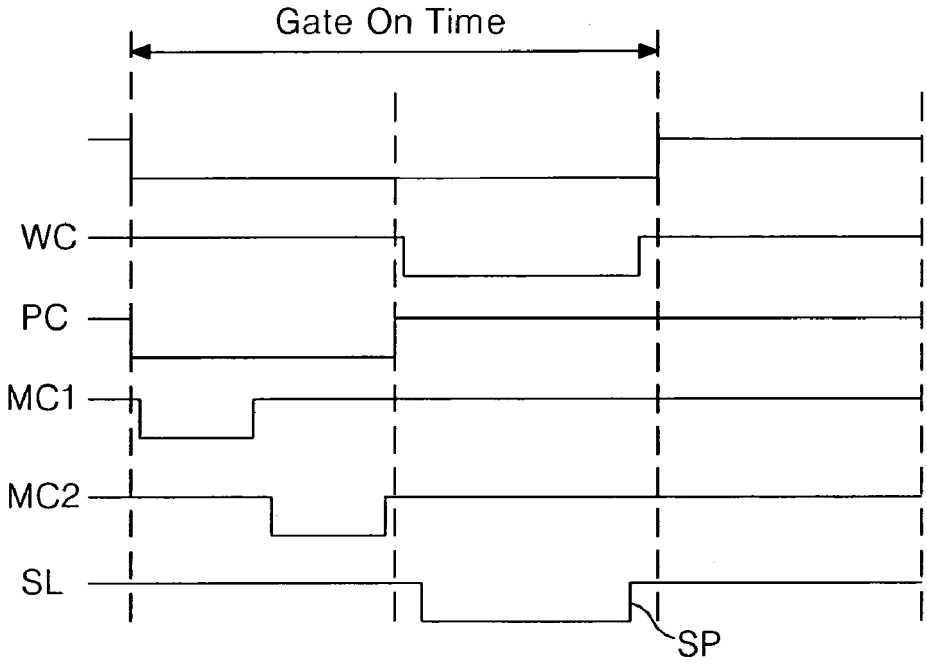
FIG. 7 is a waveform diagram of a scanning pulse, a selection signal and a data signal applied to the scan electrode line shown in FIG. 6.

Referring to FIG. 7, the first and second selection signals MC1 and MC2 are sequentially applied to the multiplexer 150 during the OFF time of the scan electrode line SL, which is called a first half time. The pre-charging signal PC is applied to the pre-charger 160 during a the first half time of the scan electrode line SL. The writing signal WC is applied to the multiplexer part 150 in such a manner to be synchronized with a scanning pulse SP applied to the scan electrode line SL.

The multiplexer part 150 includes m writing switching devices W1 to Wm connected to the respective data electrode lines DL, m buffers B1 to Bm connected to the respective m writing switching devices W1 to Wm, m multiplexer switching devices M1 to Mm connected to the respective m buffers B1 to Bm and commonly connected to the respective output channels of the data driver for each k unit, and m capacitors C1 to Cm connected between nodes positioned between the multiplexer switching devices M and the buffers B and the ground voltage line GND.

The k multiplexer switching devices M1 to Mk are commonly connected to each one of the output channels 121 of the data driver 120. For simplicity, it is assumed in the EL display device according to the second embodiment of the present invention that first and second multiplexer switching devices M1 and M2 are connected to each output channel of the data driver 120. Accordingly, the first and second multiplexer switching devices M1 and M2, the first and second buffers B1 and B2, the first and second capacitors C1 and C2 and the first and second writing switching devices W1 and W2 constitute a single of multiplexer MUX.

Figure 8:
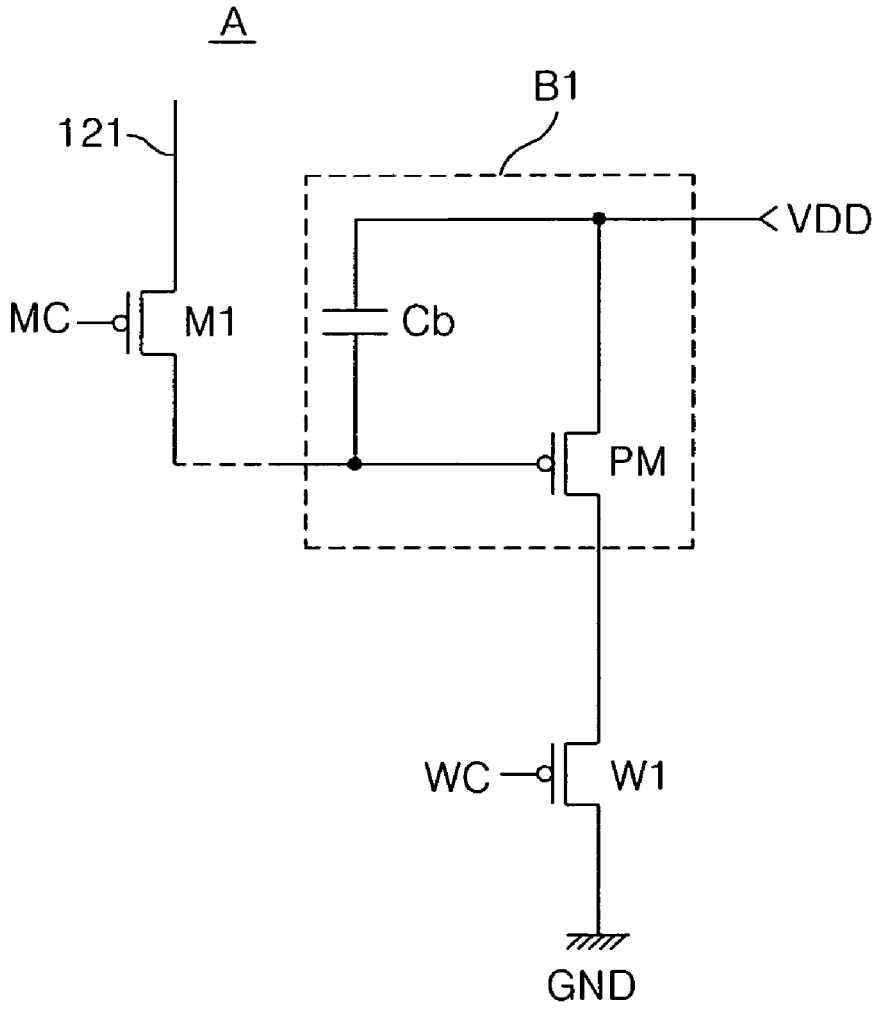
FIG. 8 is a circuit diagram illustrating the "A" portion shown in FIG. 6 in detail.

The first selection signal MC1 is applied from the timing controller 128, via a first selection signal line, to the gate terminals of the odd-numbered multiplexer switching devices M1, M3, M5, . . . , M−1 including the first multiplexer switching device M1, while the second selection signal MC2 is applied from the timing controller. 128, via a second selection signal line, to the gate terminals of the even-numbered multiplexer switching devices M2, M4, M6, . . . , Mm including the second multiplexer switching device M2. The first and second multiplexer switching devices M1 and M2 of the multiplexer MUX are sequentially switched during the first half of the ON time of the scan electrode line SL in response to the first and second selection signals MC1 and MC2 from the timing controller 128. Then, each of the m capacitors C1 to Cm charges a data voltage supplied via the output channel 121 of the data driver 120 in response to a switching of the respective m multiplexer switching devices M1 to Mm. Each of the m buffers B1 to Bm provides a signal buffering such that a data voltage stored in each of the m capacitors C1 to Cm is applied, via the respective m writing switching devices W1 to Wm, to the data electrode line DL. In this case, each of the m buffers B1 to Bm includes a complementary metal-oxide-semiconductor (CMOS) transistor. As shown in FIG. 8, each of the m buffers B1 to Bm includes a p-type transistor PM connected between the supply voltage line VDD and the writing switching device W, and a capacitor Cb connected between the gate terminal of the p-type transistor PM and the supply voltage line VDD. The source terminal of the p-type transistor PM is connected to the supply voltage line VDD, the drain terminal thereof is connected to the writing switching device W, and the gate terminal thereof is connected to the multiplexer switching device M. Each of the m writing switching devices W1 to Wm is switched such that a data voltage stored in each of the m capacitors C1 to Cm is supplied, via the respective m buffers B1 to Bm, to the data electrode line DL in response to a writing signal WC from the timing controller 128.

The pre-charger 160 includes m pre-charging switching devices S1 to Sm, each of which is connected to each end of the data electrode lines DL and the ground voltage line GND. Each of the m pre-charging switching devices S1 to Sm charges a low voltages LOW to the data electrode line DL in advance in response to a pre-charging signal PC from the timing controller 128. Such a pre-charger 160 pre-charges a low voltage to the data electrode lines DL, thereby allowing the m buffers B1 to Bm to operate in response to a high input, because each of the m buffers B1 to Bm including a PMOS transistor outputs a high level High in response to a low input, but does not operate in response to a high input.

An operation of the EL display device according to the second embodiment of the present invention will be described in detail with reference to FIGS. 6 and 7.

First, the first and second selection signals MC1 and MC2 from the timing controller 128 are applied to the multiplexer part 150 during an ON time corresponding to the first half of the ON time of the scan electrode line SL. Then, each of the multiplexer MUX sequentially applies a data voltage supplied from each output channel 121 of the data driver 120 to the first and second capacitors C1 and C2 in response to the first and second selection signals MC1 and MC2. Accordingly, each of the first and second capacitors C1 and C2 of the multiplexer MUX stores a data voltage supplied via each of the first and second multiplexer switching devices M1 and M2. At this time, each of the m pre-charging switching devices S1 to SM connects the data electrode lines DL to the ground voltage line GND in response to the pre-charging signal PC from the timing controller 128, thereby pre-charging the data electrode line DL with a low voltage.

Subsequently, a scanning pulse SP is applied from the scan driver 118 to the scan electrode line SL and, at the same time, a writing signal WC is applied from the timing controller 128 to the multiplexer part 150. Then, each of the multiplexers MUX applies a data voltage stored in each of the first and second capacitors C1 and C2, via each of the first and second buffers B1 and B2 and each of the first and second writing switching devices W1 and W2, to the data electrode lines DL pre-charged with a low voltage.

Accordingly, in each pixel cell of the EL display device according to the second embodiment of the present invention, when a scanning pulse SP having a low state LOW is inputted from the scan driver 118 to the scan electrode line SL, then the switching TFT SW is turned on. As the switching TFT SW is turned on, a data voltage supplied from the data driver 120, via the multiplexer part 150, to the data electrode line DL pre-charged with a low voltage is applied, via the switching TFT SW, to the first node N1 in such a manner to be synchronized with the scanning pulse SP applied to the scan electrode line SL. The data voltage applied to the first node N1 is stored in the storage capacitor Cst. The storage capacitor Cst stores the data voltage from the data electrode line DL during an application time of the scanning pulse SP to the scan electrode line SL. Such a storage capacitor Cst holds the stored data voltage during one frame. In other words, the storage capacitor Cst applies the stored data voltage to the driving TFT DT even when the scanning pulse SP is not applied to the scan electrode line SL, to thereby turn on the driving TFT DT. Thus, the light-emitting cell OLED is turned on by a voltage difference between the supply voltage line VDD and the ground voltage GND, thereby emitting light in proportion to a current amount applied from the supply voltage line VDD via the driving TFT DT.

In the EL display device according to the second embodiment of the present invention, the scan driver 118 is integral to the EL display panel 116 in a row direction, and the output channels 21 of the data driver 20 and the data electrode lines DL1 to DLm form an one-to-two matching in a column direction with respect to each other by the multiplexer part 150. Accordingly, the EL display device can reduce the number of the output channels 121 of the data driver 120 corresponding to the number of the data electrode lines DL1 to DLm by half. Meanwhile, in the EL display device according to the second embodiment of the present invention, the output channels 121 of the data driver 120 and the data electrode lines DL1 to DLm can also form an one-to-k matching with respect to each other by the multiplexer part 150, which can reduce the number of the output channels 121 of the data driver 120 corresponding to the number of the data electrode lines DL1 to DLm to DL/m channels.

As described above, the EL display device according to the present invention includes a multiplexer part for forming an one-to-k matching of the output channels of the data driver with respect to the data electrode lines, with the multiplexer part having buffers for buffering a data voltage from the data driver to apply the buffered data voltage to the data electrode line. Accordingly, it becomes possible to reduce the number of output channels of the data driver corresponding to the number of data electrode lines by 1/k. Although the first and second embodiments of the present invention are explained with reference to an organic EL display device, it should be understood that the principles of the present invention are applicable to other types of display devices.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence (EL) display device, comprising:

an EL display panel having a plurality of pixel cells;

m data electrode lines (wherein m is a positive integer) and a plurality of scan electrode lines in the EL display panel, the data electrode lines and the scan electrode lines defining the pixel cells;

a data driver having a plurality of output channels for supplying data signals to the m data electrode lines;

a multiplexer for connecting each output channel of the data driver to k data electrode lines (wherein k is an integer greater than 2), wherein the multiplexer includes m writing switching devices connected to the respective data electrode lines; m multiplexer switching devices commonly connected to each output channel of the data driver for each k unit; m buffers connected between respective multiplexer switching devices and the respective writing switching devices; and m capacitors connected between a node positioned between the multiplexer switching devices and the buffers and a ground voltage line to temporarily store the data signals supplied via the multiplexer switching devices;

a scan driver for sequentially applying a scanning pulse during a gate on-time to the plurality of scan electrode lines, wherein the scanning pulse has an OFF time and an ON time of each of the scan electrode lines during the gate on-time; and a timing controller for generating control signals to control the data driver and the scan driver, and generating k selection signals to sequentially switch the k of the m multiplexer switching devices during the OFF time of the scan electrode line within the gate on-time and a writing signal to simultaneously switch the m writing switching devices in such a manner to be synchronized with the scanning pulse during the ON time of the scan electrode line within the gate on-time, wherein the writing signal is synchronized with the scanning pulse, wherein the m multiplexer switching devices are sequentially switched on during the OFF time of the scan electrode line, and the m writing switching devices are simultaneously switched on when the m multiplexer switching devices are switched off during the ON time of the scan electrode line.

2. The EL display device according to claim 1, further comprising:

a pre-charger connected to each of the data electrode lines to pre-charge each of the data electrode lines.

3. The EL display device according to claim 2, wherein the pre-charger includes:

m pre-charging switching devices connected between each end of the data electrode lines and a ground voltage line.

4. The EL display device according to claim 3, wherein the timing controller further generates a pre-charging signal for switching the m pre-charging switching devices.

5. The EL display device according to claim 4, wherein the m pre-charging switching devices are switched during the OFF time of the scan electrode line.

6. The EL display device according to claim 1, wherein each of the pixel cells includes:

a light-emitting cell connected between a supply voltage line and a ground voltage line;

a driving switch connected between the supply voltage line and the light-emitting cell;

a switching device connected to the scan electrode line, the data electrode line and the driving switch; and a capacitor between a node between the driving switch and the switching device and the supply voltage line.

7. A flat panel display device, comprising:

a display panel having a plurality of pixel cells;

m data electrode lines (wherein m is an integer) and a plurality of scan electrode lines in the display panel, the data electrode lines and the scan electrode lines defining the pixel cells;

a data driver having a plurality of output channels for supplying data signals to the m data electrode lines; and a multiplexer for connecting each output channel of the data driver to k data electrode lines (wherein k is an integer greater than 2), wherein the multiplexer includes m writing switching devices connected to the respective data electrode lines; m multiplexer switching devices commonly connected to each output channel of the data driver for each k unit; m buffers connected between respective multiplexer switching devices and the respective writing switching devices; and m capacitors connected between a node positioned between the multiplexer switching devices and the buffers and a ground voltage line to temporarily store the data signals supplied via the multiplexer switching devices;

a scan driver for sequentially applying a scanning pulse during a gate on-time to the plurality of scan electrode lines, wherein the scanning pulse has an OFF time and an ON time of each of the scan electrode lines during the gate on-time; and a timing controller for generating control signals to control the data driver and the scan driver, and generating k selection signals to sequentially switch the k of the m multiplexer switching devices during the OFF time of the scan electrode line within the gate on-time and a writing signal to simultaneously switch the m writing switching devices in such a manner to be synchronized with the scanning pulse during the ON time of the scan electrode line within the gate on-time, wherein the writing signal is synchronized with the scanning pulse, wherein the m multiplexer switching devices are sequentially switched on during the OFF time of the scan electrode line, and the m writing switching devices are simultaneously switched on when the m multiplexer switching devices are switched off during the ON time of the scan electrode line.

8. The flat panel display device according to claim 7, further comprising:

a pre-charger connected to each of the data electrode lines to pre-charge each of the data electrode lines.

9. The flat panel display device according to claim 8, wherein the pre-charger further includes m pre-charging switching devices connected between each end of the data electrode lines and a ground voltage line.

10. The EL display device according to claim 1, wherein the k data electrode lines connected to the output channel of the data drive are neighbored each other.

11. The flat panel display device according to claim 7, wherein the k data electrode lines connected to the output channel of the data drive are neighbored each other.

* * * * *